US005841419A

United States Patent [19]

Maltese

[11] Patent Number: 5,841,419

[45] Date of Patent: Nov. 24, 1998

[54] CONTROL METHOD FOR FERROELECTRIC LIQUID CRYSTAL MATRIX DISPLAY

[75] Inventor: Paolo Maltese, Rome, Italy

[73] Assignee: Universita' Degli Studi Di Roma 'La Sapienza', Rome, Italy

[21] Appl. No.: 596,187

[22] PCT Filed: Aug. 18, 1994

[86] PCT No.: PCT/IT94/00138

§ 371 Date: Feb. 13, 1996

§ 102(e) Date: Feb. 13, 1996

[87] PCT Pub. No.: WO95/06308

PCT Pub. Date: Mar. 2, 1995

[30] Foreign Application Priority Data

Aug. 20, 1993 [IT] Italy ..... RM93 A 000567

[51] Int. Cl.[6] ..... G09G 3/36

[52] U.S. Cl. ..... 345/97; 345/94

[58] Field of Search ..... 345/97, 94, 95, 345/96, 208, 209, 210; 349/33, 37, 54, 36; 348/790, 792

[56] References Cited

U.S. PATENT DOCUMENTS

| | | | |
|---|---|---|---|
| 5,162,932 | 11/1992 | Kobayashi et al. | 345/95 |
| 5,379,050 | 1/1995 | Annis et al. | 345/94 |
| 5,459,481 | 10/1995 | Tanaka et al. | 345/95 |
| 5,519,411 | 5/1996 | Okada et al. | 345/95 |

FOREIGN PATENT DOCUMENTS

| | | |
|---|---|---|
| 0 545 400 A2 | 6/1993 | European Pat. Off. . |
| 0 564 263 A2 | 10/1993 | European Pat. Off. . |
| 0 605 865 A1 | 7/1994 | European Pat. Off. . |

*Primary Examiner*—Dennis-Doon Chow
*Attorney, Agent, or Firm*—Beveridge, DeGrandi, Weilacher & Young, LLP

[57] ABSTRACT

Subject-matter of this invention is a control method for a ferroelectric liquid crystal matrix display panel wherein use is made of selection voltages comprising at least four impulses, more particularly voltages having substantially an identical polarity in finite time intervals, at each refresh step of the panel, the last two pulses being consecutive and having opposite polarities, having absolute values of the voltage integral with respect to time within well established limits during each pulse and wherein use is also made of well specified control time windows. Regarding the last pulse, said absolute value of the voltage integral with respect to time is in the range of 0.2 Amin to Amin; regarding the last-but-one pulse, it is in the range of 0.2 Amin to 3 Amin; regarding a (compensation) pulse prior to the two above pulses, it is in the range of 0.8 Amin to 3 Amin and, regarding a (blanking) pulse prior to the above three pulses, it is in the range of 1 to 10 times the value of the compensation pulse. Furthermore, the associated corresponding control time window is partially overlapped to the last-but-one pulse, for at least two and no more than four fifths of the whole duration of said window.

42 Claims, 2 Drawing Sheets

FIG. 1
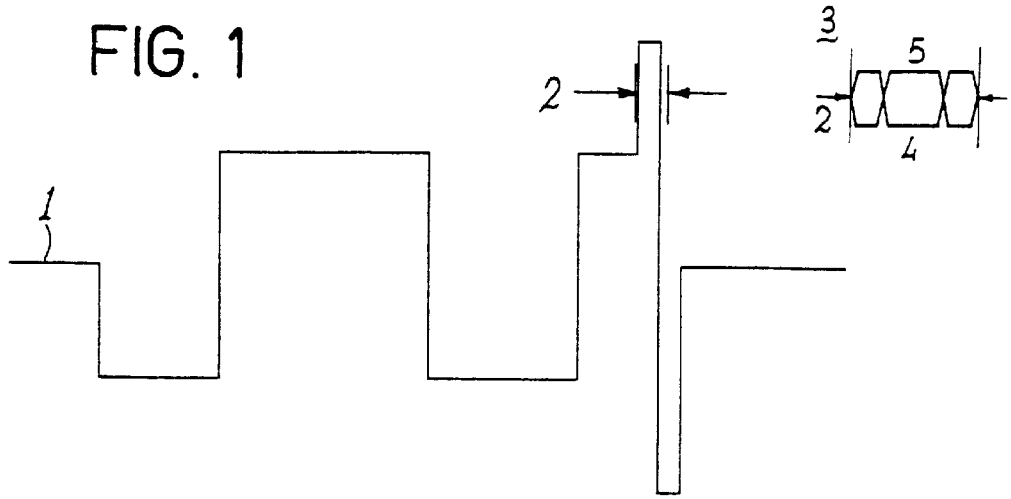
FIG. 2
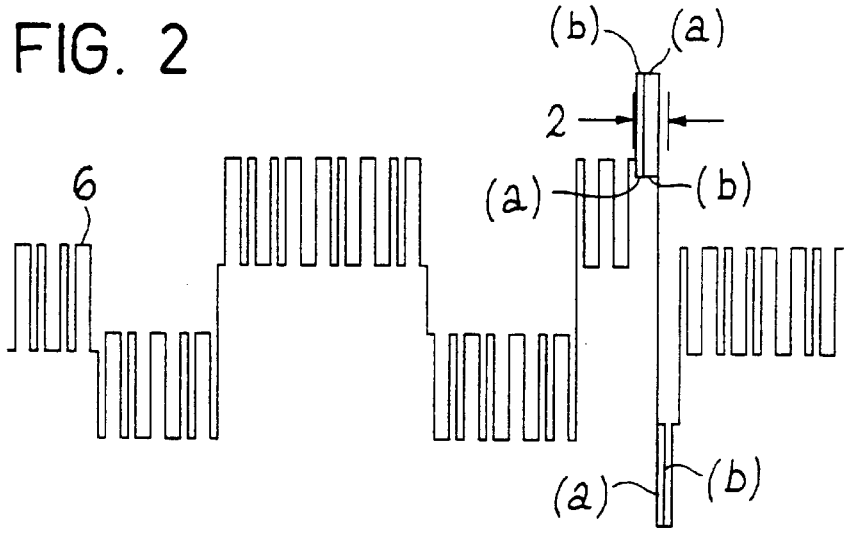
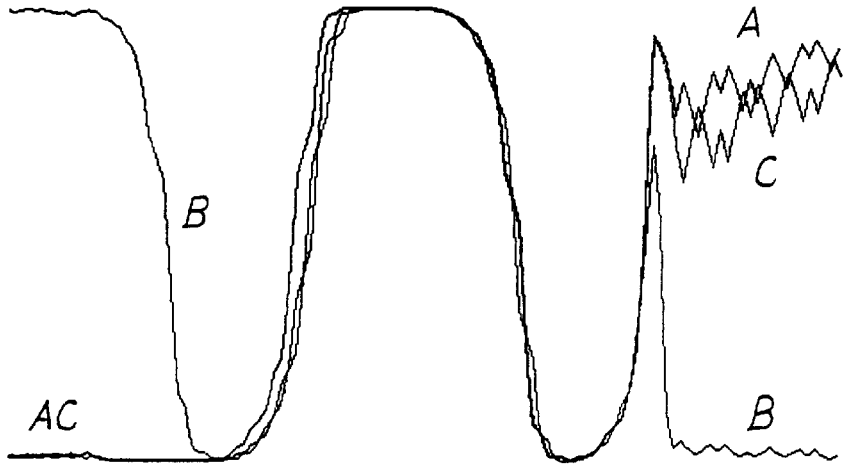
FIG. 3

CONTROL METHOD FOR FERROELECTRIC LIQUID CRYSTAL MATRIX DISPLAY

SUMMARY OF THE INVENTION

This invention broadly relates to liquid crystal matrix panels and more particularly it refers to a control method for matrix panels of a direct addressing, ferroelectric liquid crystal (FLC) type, to enable their improved operation.

As it is known, the panels to which this invention relates are used in devices for displaying images and for optical computation applications, both of the projection and of the direct vision types In this devices, each picture element (pixel) ideally corresponds to the intersection of an element of a first electrode set (for instance arranged as rows) and an element of a second electrode set (for instance arranged as columns) and materially it corresponds to an electro-optical cell comprising a ferroelectric liquid crystal in the room existing between two facing electrodes belonging to the above mentioned two electrode sets. In usual arrangements, a pair of crossed polarizers operatively completes the cell and makes the orientation changes visible of the director in the liquid crystal that can be of smectic C chiral type.

The device as a whole comprises the assembly of the described panel with the related electronic circuitry to generate the various voltage signals needed for its operation and with the interconnection elements to the panel electrodes. According to the expected application, in addition, polarizers, color filters, light sources and an optical system can be provided therein.

This invention additionally consists in the device comprising the above set forth assembly and operating according to the hereinafter described control method.

More precisely, this invention relates to a directly addressed FLC matrix panel wherein the ferroelectric liquid crystal cells operate according to a bistable or multistable behaviour in absence of voltage or in presence of a continuously applied, high frequency voltage having a sufficient and suitable rms amplitude, known as high frequency or alternated current stabilization voltage. The ferroelectric liquid crystal can be of smectic C chiral type and the cells can be of the chevron or partially straightened up chevron type. In both cases, the smectic layers are straightened up chevron type. In both cases, the smectic layers are approximately broken up into two halves, which are tilted in opposite directions with respect to a line normal to the cells, at an angle equal to (between 110% and 75% in the first case) or much smaller than (between 0% and 75% in the latter case) the characteristic angle of the SmC phase. Reference is made, for instance to P. Maltese, "Advances and problems in the development of ferroelectric liquid crystal displays", in Molecular Crystals and Liquid Crystals, Gordon and Breach, vol. 215, pages 57 and figures and to the references cited therein.

It is possible to obtain, as a result of each pulse, a cyclic transition of a cell from one extreme state to the other, by means of spaced apart rectangular pulses, of alternatively opposite polarities, possibly when a high frequency stabilization voltage Vhf having a predetermined rms amplitude is present between such pulses. This effect occurs when such pulses have a sufficient duration, which is a function of the amplitude of the pulses themselves (for a given rms stabilization voltage). Such sufficient duration has a minimum value, corresponding to a voltage Vtmin, below which the product of each sufficient duration by the corresponding pulse voltage varies to a small extent but at the same time it has a minimum value Amin in the voltage range between one and eight tenths of Vtmin. Often it is not possible to apply to the cells voltages sufficiently high to observe that the sufficient duration of the pulses increases as the voltage increases: in such case, the Vtmin should be evaluated by extrapolating the behaviours of the cells as observed at the applicable voltages.

Sufficiently small values of Vhf and Vtmin are achieved, as desired, when a large enough positive biaxiality of the dielectric constant tensor of the liquid crystal is available, A uniform cell is characterized by the three above mentioned parameters, among which Amin is the most important one, as well as by the dependance of Vtmin and Amin on Vhf. As a matter of fact, such parameters vary from cell to cell of the display panel as a consequence of the manufacturing tolerances (thickness) and of the temperature difference. A mathematical model to describe the operation of the cells is reported by P. Maltese, R. Piccolo, "Superfast addressing modes for SSFLC Matrix Displays" at pages 642 and figures in Digest of Technical Papers, 1993 Intl. SID Symposium, available from the Society for Information Displays, 1526 Brookhollow Drive, Suite 82, Santa Ana, Calif. 92705-5421, as well as in references cited in said paper.

The panel consisting of FLC cells can be electrically controlled according to various addressing modes or schemes, capable to determine the state of all cells by means of a number of voltage signals to be applied to the two electrode sets, such signal number being much smaller than the number of controlled cells. The main subject-matter of this invention is a novel addressing method, as it will be explained hereinafter.

Many known addressing modes for FLC panels contemplate different operations wherein, by means of said signals, it is possible to erase the previous image (blanking) and to store a new image (write), in well defined time intervals, which is meant as "refresh" of the panel. Between successive refreshes, it is possible to hold images stored on the panel, both when voltages are absent and when voltages are present to control other portions of the panel and when any high frequency stabilization voltages are present. The refresh rates are suitable also when moving images are to be displayed.

In many cases, the display refresh is carried out electrode by electrode of a first set, according to a scanning scheme wherein the writing operation is contemporaneously performed for all pixels belonging to a given electrode, for instance row by row. This very common case will be often referred to hereinafter, by way of exemplification and not by way of limitation, for the sake of concreteness and simplicity of explanation. It should be apparent, in fact, that the roles of the rows and of the columns can be exchanged and that the electrodes can be arranged according to a quite different geometrical pattern.

Many already known addressing methods, therefore, provide for refreshing the panel on the base of successive rows, in usually partially overlapping times, as determined by scan or selection voltages applied to the row electrodes, independent on the image. Said selection voltages, in correspondence to the refreshes, comprise in the first place one or more blanking pulses, which cause the erasure of the previously stored image, so as to switch anyhow the cells of a row to a well defined state, independently on the concurrently applied column voltages. As it is also known, such erasure can also be carried out concurrently to the erasure of other rows and to writing a further row. The selection voltages corresponding to the refreshes additionally comprise one or more subsequent pulses causing the cells of the concerned row to be switched to a state depending on the voltages applied to the columns, only within a time slot or window.

This window can be shorter than the comprehensive duration of the subsequent pulses and its width is equal to the minimum time difference between equal selection voltages than can be employed in respect of two different rows. Its duration is designated as row addressing time and it determines the number of rows that can be addressed between two refreshes. The refresh time, on the other hand, is the time lapsing from the beginning of a blanking pulse and the latest selection pulse. It should be small in comparison to the time interval between two successive refreshes, even if, on the other hand, it can be large with respect to the row addressing time.

At each refresh, therefore, the display control procedure provides for controlling the rows one by one in successive times. In one and same time window as defined by a selection voltage, the states stored in all of the cells in a row are determined depending on the data voltages applied to the column electrodes, as a function of the new row of the image to be written.

In any case, selection voltages are applied to the electrodes of a first set and each of these voltages is associated, at each refresh of the display, to a different control time window for all of the cells corresponding to the electrode of the first set (selected electrode). To the electrodes belonging to the second set data voltages are applied, each of which is formed by superposing the data voltage segments applied within the different time windows associated to the selection voltages, designed for controlling all of the cells corresponding to the electrodes belonging to the second set. Each data item by which a pixel of the image to be displayed is described, in a description pixel by pixel of the image, determines the data voltage pertaining to the electrode of the second set within the time window corresponding to the electrode of the first set.

It is known that, when it is desired to avoid the undesired introducible state changes of cells not belonging to the selected electrode, each data voltage segment should have the same average value, independently on the data item and on the concerned pixel. In addition, each data voltage and each selection voltage should have identical average values, independent on the data assembly (on the image) and on the concerned electrode. Without jeopardizing the broad concepts heretofore set forth, the above mentioned average value will be considered in the following description as a reference value with respect to which each voltage will be measured.

All above described features are common to both the addressing method according to this invention and to the prior art addressing methods.

As it appears from the above mentioned references, preliminarly to this invention the matrix addressing problems of FLC cells have been closely investigated and various novel addressing modes and, more recently, a simplified model of a ferroelectric liquid crystal cell capable to forecast its operation characteristics in connection with the matrix addressing have been achieved.

The "fast and superfast" or "high voltage" addressing modes discussed in the references of the inventor himself et al are based upon use of relatively high voltages, so that the tensor dielectric properties of the ferroelectric liquid crystal become relevant. Among the above mentioned ones, the modes or patterns having the shortest corresponding row addressing times also have to the maximum extent the disadvantage of a limited range for the Amin values of the cells in a panel, compatible with their operation. As a matter of facts, such range is smaller than the effects of the manufacturing tolerances and of the temperature variations. When an attempt is made to apply said addressing modes to a display consisting of a large number of pixels, it is not possible to adjust the amplitudes and the timings of the voltage signals employed so as to achieve a correct operation of the whole panel.

It is an object of this invention to enlarge to the maximum possible extent the ranges of the temperature values, of all manufacturing parameters as well as of Amin, for which it will be possible to achieve a correct operation of the cells controlled according to this invention.

By applying a numerical simulation with said model and thanks to detailed experimental studies effected within the scope of this invention, it has been possible to realize that, at a first approximation level, the Amin variations have the same effects as the amplitude or duration variations occurring in the signals, in particular in the selection signals. Such variations cause increases or decreases in the optical response of each cell, at the end of the refresh time, and, should they become excessive, they cause such optical response to fall outside the useful range for control purposes by the data voltage segment in the corresponding control time window.

All above said can be made apparent both in the numerical simulation according to the above mentioned model and in the experimental tests carried out, by substituting a high frequency voltage having the same rms amplitude for the data voltage within the corresponding time window. In the control methods according to the prior art, the response at the end of the refresh time is severely dependent on the voltage or time scale of the selection voltages. When such a response is plotted as a function of the scale time or of the scale voltage, it can be observed that it rapidly runs through a range of useful values located around the conditions intermediate between the two extreme states of a cell and corresponding to the unstable equilibrium point of a bistable cell, for which the normal data voltage would surely cause the one or the other desired state to be stored therein.

This invention stems from the discovery that, even in the case of a fast addressing method with relatively high voltages, it is possible to employ for the selection signals waveforms such that, when a high frequency voltage having an identical rms amplitude is substituted for the data voltage segment in the concerned time window and when all of the amplitudes or all of the durations of said signals are increased according to the same scale factor, the optical response at the end point of the control window firstly reaches a maximum point and subsequently it decreases again (or it reaches a minimum point and then increases again). It has also been found that, when said control window is followed in the selection signals by a final pulse having calibrated amplitude and duration values, it is possible to bring such maximum (or minimum) value within the above mentioned range of useful values, at the end of said final pulse (or at the end of the refresh time). If the above described experimental test or simulation are then repeated and the response at the end of the refresh time is plotted, it can be found that it oscillates within the useful range. The corresponding addressing method then operates correctly in a large range of voltages and times, in respect of a determined cell and in respect of a large range of the cell descriptive parameters, provided that times and voltages well within the above mentioned operation range for a typical cell are used.

The above described behavior has been realized in chevron cells containing a liquid crystal having a spontaneous polarization between 2 and 15 nC/cm$^2$ as well as in the numerical simulation according to the above mentioned model by means of waveforms according to the invention. The invention, therefore, consists in using selection voltages comprising at least four pulses, i.e. voltages having substantially always the same polarity in finite time intervals, at each refresh of the display, wherein the last two pulses are consecutive and of opposite polarities and all pulses have the absolute values of the integral of the voltage with respect to time, during each pulse, within hereinbelow specified limits, the invention furthermore consisting in using control time windows as hereinbelow specified. As concerns the last pulse, said absolute value of the time integral of the voltage is in the range of 0.2 Amin to Amin; as concerns the last-but-one pulse, it is in the range of 0.2 Amin to 3 Amin; as concerns a (compensation) pulse prior to the two above mentioned ones, it is in the range of 0.8 Amin to 3 Amin and, as concerns a (blanking) pulse prior to the three above mentioned ones, it is in the range of 1 to 10 times the value of the compensation pulse. In addition, the associated corresponding control time window is partially overlapped to the last-but-one pulse, to an extent of at least two and no more than four fifths of the whole duration of said time window.

The last pulse is designed so as to bring the optical response of the cell at the end thereof within the above described useful range. The last-but-one pulse is designed so as to enable a high sensitivity of the response to the voltage within the control window to be achieved. The compensation pulse brings the optical response at its end point to a nearly saturated condition, thereby causing a maximum or a minimum value to appear in the optical response at the end of the refresh time. This is possible if the state of the concerned cell at the begin of the compensation pulse is made independent on the image displayed before the refresh. This function is performed by the previous blanking pulse, at the end of which the optical response is substantially independent on the state of the cell at the beginning of the refresh time.

Within the control time windows, it is possible to adopt various known approaches in respect of the waveforms of the data voltages. It will be preferred, however, to use a technique corresponding to the "super fast" methods described in the second above mentioned reference or to a technique corresponding to the "fast" methods referred to in the same reference. In this case, said control window begins during the second half of the last-but-one pulse and ends after the first fifth of the last pulse, upon which it overlaps for at least one fifth of the duration of said window. A disadvantage of said method is the need that the data voltages have high rms amplitudes. A further preferred approach which enables lower data voltages to be employed uses data windows each of which is divided into subwindows, namely spaced apart time intervals, comprising the times at which the polarity changes associated to the last-but-one pulse take place.

The above mentioned blanking pulse advantageously can be separated from the subsequent (three or more) pulses by means of a pause having a duration that can also be variable, provided that is sufficiently long. Such duration is preferably between the comprehensive duration of the last two pulses and one half of the minimum time between two successive refreshes.

Assuming that the relative durations and amplitudes of the pulses are correctly chosen within the above indicated value ranges, it can be realized that, when all data voltage segments are substituted by high frequency voltages having the same rms amplitude and as all amplitudes or all durations appearing in the selection voltage are increased starting from zero, firstly the optical responses at the end of the blanking pulse saturate, in the second place the optical responses at the end of the compensation pulse saturate and lastly the optical responses at the end of the subsequent pulses saturate. A trend inversion, in respect of the variations of the optical response at the end of the series of pulses corresponds to each of the above mentioned saturation steps and said optical response can oscillate within a restricted range, rather than rapidly running through it. The effect of the data item in the control window appears then to be decisive in respect of the final state taken by the cell and the addressing scheme can correctly operate within large limits for the amplitudes and durations of the selection voltages employed.

It will be additionally apparent that further pulses or pauses having absolute values of the corresponding integrals of the voltage with respect to time lower than 0.2 Amin can be introduced into the above described selection pulse succession, also at its end portions, without substantially modifying the selection waveform or the just described behavior. In view of the above, the description of this invention and in particular the description of the procedure for counting the pulses omits considering any presence in the selection voltage of further pulses or pauses, the corresponding integrals of the voltages with respect to time of which have values lower than 0.2 Amin.

A drawback of the above described waveforms, which has been found in chevron cells with liquid crystals having a spontaneous polarization between 2 and 15 nC/cm$^2$, when only four pulses are employed, is due to the fact that the single blanking pulse (last-but-four pulse) should be larger than the one requested for it to compensate the direct current component connected with the last three pulses. It is possible and necessary to null the DC component of the selection voltages, either by using opposite polarities for the sufficiently close, successive refresh pulses, or by adding small offset voltages, such as generated by a possible capacitive coupling. It is preferable, however, that the DC component be nulled within the refresh time by inserting further pulses before the above mentioned blanking pulse, so as to obtain an average null value of the voltage in the refresh time. As a matter of fact, it has been found satisfactory to this effect that a single pulse be inserted having opposite polarity with respect to the subsequent (last-but-four) pulse by which the erasure is completed.

It has been found that it is convenient, in order to reach the maximum operation speed of the panel, to use selection voltages having amplitudes as high as possible, connected to Vtmin. By the same reasons, for predetermined voltage levels, depending for instance on the integration technology employed for manufacturing the driver circuits, it will be advisable to use cells characterized by a Vtmin having an as small as possible value. It has been found that it will be convenient to use a last-but-one and a last pulse having their peak amplitudes in the range from twice and one tenth of the voltage Vtmin and to use the other pulses having their peak amplitudes lower than or equal to four thirds of the peak amplitude of the last pulse.

As far as the voltages applied to the cells after and between the row refresh pulses are concerned, they appear to be equal to the differences between any high frequency stabilization voltages, contained in the row selection voltages, and the data voltages applied to the columns. It appears to be convenient that the rms amplitude of such difference voltage be constant as a function of the time as well as independent on the data. As it is known, this result can be obtained when the waveforms for each data item have null correlation with any stabilization voltages that are present on the rows and have a rms amplitude value independent on the desired optical transmission value (white or black or intermediate shade) for the pixel. For instance, the data voltage can be made up of three successive rectangular pulses having the same amplitude and opposite polarities, whose products time x voltage upon being added together are balanced; when desired shade is varied, the duration of the first pulse varies, but the duration of the second one is constant. The number of pulses is restricted to two in the extreme cases wherein a white or a black pixel is to be obtained. As far as the row stabilization voltages are concerned, a square wave having a sufficiently high frequency can be used. However, it has been found that it is convenient that no stabilization voltage be used and that the rms amplitudes of the data voltages be increased, so that this amplitude is sufficient to achieve a high frequency stabilization effect for the cells. In the best conditions, this result can be obtained when the rms amplitude is in the range between one tenth and four thirds of the peak amplitude of the row voltages.

Furthermore, as it has been disclosed in the last mentioned paper, it has been found that it is convenient to use crosstalk-compensated waveforms for the data voltages. This compensation has been identified in data voltage segments whose integral, computed from the starting point of the corresponding control time window up to any time therewithin, is a time function having an approximately null average value over the control time window, independently on the data item by which the pixel is described. This condition together with the balance one can be fulfilled, for extreme shades corresponding to white and to black, when the data voltages are made up by three successive pulses, having the same amplitude and opposite polarities, wherein the durations of the first and of the last one are one half of the duration of the second one. As concerns the intermediate shades, four pulses can be used, having the same amplitude, opposite polarities and variable durations, designed to fulfill the above conditions.

As it is known from the liquid crystal display technology, it is evident that, for instance aiming at decreasing the peak amplitudes of the signals generated by the row driving circuits, it will be possible to substitute, for the above described selection voltages and data voltages, an equivalent waveform assembly obtained by adding a single voltage function of the time to each selection voltage and data voltage. In fact, even if it modifies each signal, such addition does not modify the voltage differences between the electrodes of each electro-optical cell.

Further particulars and advantages as well as characteristics and construction details will be evident from the following description with reference to enclosed drawings wherein two preferred embodiments are shown by way of illustration and not by way of limitation.

DESCRIPTION OF THE PREFERRED EMBODIMENTS

FIG. 1 shows the selection voltage as employed in a first embodiment plotted as a function of the time, corresponding to a refresh operation;

FIG. 2 shows, on the same time scale, two variants of the difference voltage between the electrodes of a cell controlled by the selection voltage of FIG. 1;

FIG. 3 shows, on the same time scale, three optical transmission diagrams in three different operation conditions;

DESCRIPTION OF THE PREFERRED EMBODIMENTS

Figure 4:
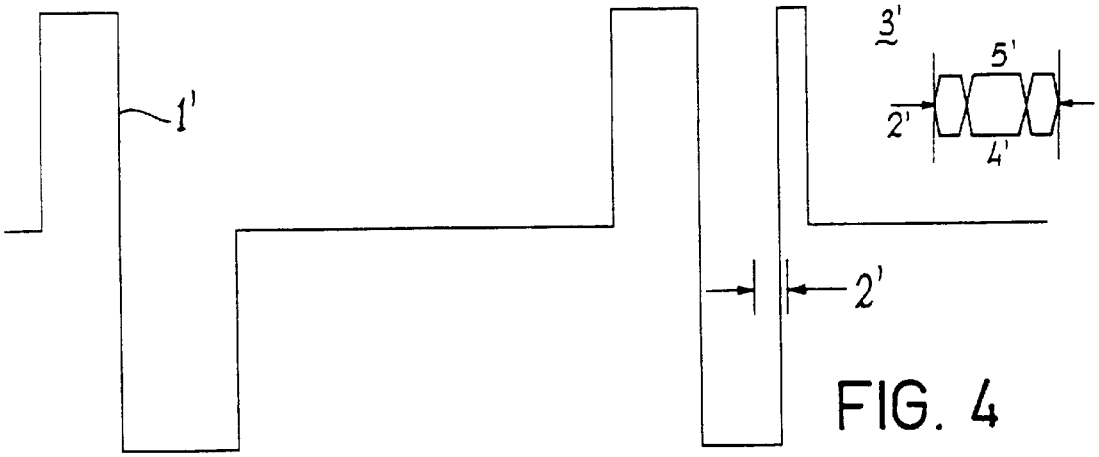
FIG. 4 shows the selection voltage as employed in a second embodiment plotted as a function of the time, corresponding to a refresh operation.

A first embodiment of this invention corresponds to FIGS. 1, 2 and 3. A liquid crystal 90-917 has been used as furnished by E. Merck at Darmstadt in a matrix display comprising chevron cells wherein a layer of liquid crystal of 1.7 micrometer thickness is oriented as a result of its contact with surfaces of rubbed polyimide resin, according to known techniques, so as to form bistable cells the temperature of which is raised to about 40° C. by heat generated by the lamps employed during operation.

Considering a generic row, FIG. 1 shows, corresponding to a refresh operation, the time plot of the selection voltage 1, having a null average value, and comprising five pulses, the second of which is designed for erasing the previous image, while the third one is the compensation pulse. The subsequent control voltages have the same shape, but they are delayed by multiples of the control time windows. FIG. 1 additionally shows the control window 2 associated to voltage 1. For what concernes the data voltage segments employed in each control window, the two following cases are shown in the inset 3, on an expanded time scale: case 4, corresponding to control of a white pixel (maximum light transmission), and case 5, corresponding to control of a black pixel (minimum light transmission).

FIG. 2 shows, on the same time scale, two variants of the difference voltage 6 between the electrodes of a cell controlled by the selection voltage 1 and by two data voltages, not shown, which are different only in correspondence to the control window 2 associated to the selection voltage 1 and corresponding: (a) to the best switching in a maximum transmission state and (b) to the worst switching in a minimum transmission state.

FIG. 3 shows, on the same time scale, the corresponding diagrams A and B for the optical transmission of the cell interposed between two crossed polarizers, oriented at 22.5° and 67.5° with respect to the rubbing direction of the surfaces contacting the liquid crystal in the cell. A third diagram C is also shown, relating to the worst switching in the maximum transmission state, corresponding to a data voltage outside the control window which has inverted sign with respect to the one producing the resulting voltage shown in FIG. 2.

More precisely, from left to right in the figure, durations of 64, 112, 80 and 32 microseconds with an amplitude of 23 Volts in connection with the first four non-zero levels illustrated in FIG. 1 and durations of 12 and 12 microseconds with an amplitude of 48 Volts in connection with the last two levels have been employed. It will be apparent that the fourth and fifth levels of same sign together are the last-but-one pulse referred to in the specification. As concerns the data voltages, an amplitude of 25 Volts has been employed together with durations of 4, 8 and 4 microseconds in respect of the pulses contained in each data window, the last of which starts concurrently with the last pulse of the selection voltage, thereby achieving a line addressing time of 16 microseconds.

Figure 5:
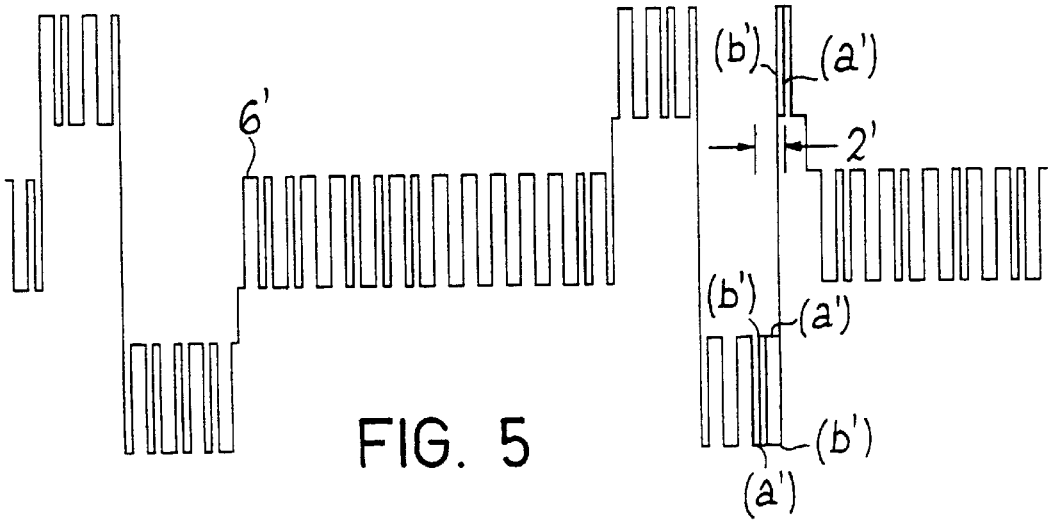
FIG. 5 shows, on the same time scale, two variants of the difference voltage between the electrodes of a cell controlled by the selection voltage of FIG. 4.
Figure 6:
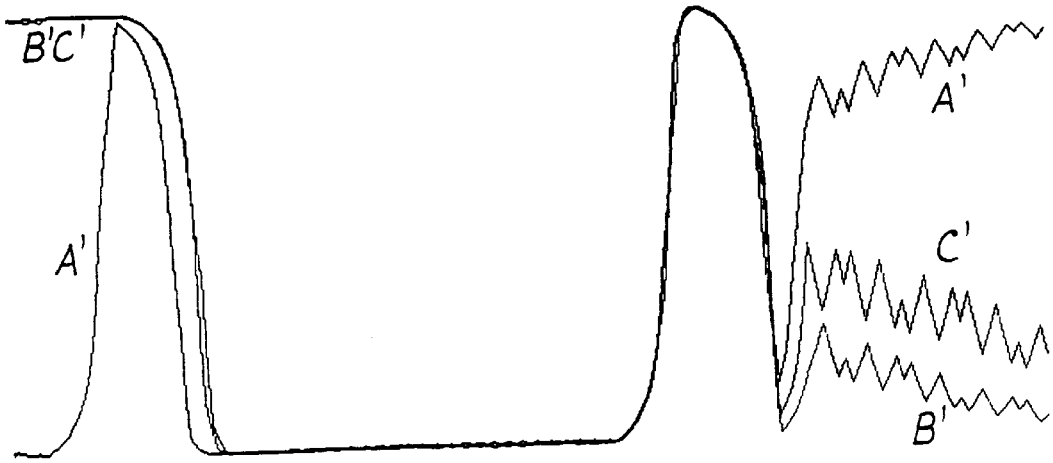
FIG. 6 shows, on the same time scale, three optical transmission diagrams in three different operation conditions.

The second embodiment corresponds to FIGS. 4, 5 and 6. Liquid crystal ZLI 4655-000 furnished by E. Merck at Darmstadt has been employed in a matrix display comprising chevron cells wherein a layer of liquid crystal of 1.7 micrometer thickness is oriented as a result of its contact with surfaces of rubbed polyimide resin, according to known techniques, so as to form bistable cells the temperature of which is raised to about 40° C. by heat generated by the lamps employed during operation.

Considering a generic row, FIG. 4 shows, corresponding to a refresh operation, the time plot of the selection voltage 1', having a null average value, and comprising five pulses, the second of which is designed for erasing the previous image, while the third one is preceded by a pause and acts as compensation pulse. The subsequent control voltages have the same shape, but they are delayed by multiples of the control time windows. FIG. 4 additionally shows the control window 2' associated to voltage 1'. For what concerns the data voltages employed in each control window, the two following cases are shown in the inset 3', on an expanded time scale: case 4', corresponding to control of a white pixel (maximum light transmission), and case 5', corresponding to control of a black pixel (minimum light transmission).

FIG. 5 shows, on the same time scale, two variants of the difference voltage 6' between the electrodes of a cell controlled by the selection voltage 1' and by two data voltages, not shown, which are different only in correspondence to the control window 2' associated to the selection voltage 1' and corresponding: (a) to the worst switching in a maximum transmission state and (b) to the best switching in a minimum transmission state.

FIG. 6 shows, on the same time scale, the corresponding diagrams A' and B' for the optical transmission of the cell interposed between two crossed polarizers, oriented at 22.5° and 67.5° with respect to the rubbing direction of the surfaces contacting the liquid crystal in the cell. A third diagram C' is also shown, relating to the worst switching in the minimum transmission state, corresponding to a data voltage outside the control window which has inverted sign with respect to the one producing the resulting voltage shown in FIG. 5.

More precisely, from left to right in the Figure, durations of 30, 42, 24, 21 and 9 microseconds with an amplitude of 25 Volts in connection with the five pulses illustrated in FIG. 4 and a pause (the duration of which has scarce relevance) after the first two pulses have been employed. As concerns the data voltages, an amplitude of 23 Volts has been employed together with durations of 3, 6 and 3 microseconds in respect of the pulses contained in each data window, the last of which starts concurrently with the last pulse of the selection voltage, thereby achieving a row address time of 12 microseconds.

In both embodiments a tolerance of about ±15% has been obtained in respect of the voltage and time variations and an identical tolerance has been obtained in respect of the thickness variations or of the viscosity/spontaneous polarization ratio variations of the liquid crystal.

The preferred embodiments of this invention have been described hereinbefore, but it should expressely be understood that those skilled in the art can make other variations and changes, without so departing from the scope thereof.

I claim:

1. A method for controlling a matrix panel in which each of a plurality of picture elements includes an electro-optical bistable cell with a ferroelectric liquid crystal, the bistable cell switching between a first state and a second state in response to spaced apart rectangular pulses having alternately opposite polarities and a constant rms voltage amplitude Vhf applied between the spaced apart rectangular pulses, when switching pulses having a large enough product of a switching pulse time and a switching pulse voltage, such large enough product having a minimum value Amin when the switching pulse voltage ranges from one to eight tenths of a minimum voltage Vtmin which allows a minimum switching pulse time, the method comprising:

applying a selection voltage waveform to at least one bistable cell, the selection voltage waveform including a last pulse having an absolute value of the time integral of the last pulse voltage in the range of 0.2 Amin to 1 Amin, a last-but-one pulse immediately preceding the last pulse having an absolute value of the time integral of the last-but-one pulse voltage in the range of 0.2 Amin to 3 Amin, a last-but-two pulse having an absolute value of the time integral of the last-but-two pulse voltage in the range of 0.8 Amin to 3 Amin, and a last-but-three pulse having an absolute value of the time integral of the last-but-three pulse voltage in the range of 1 to 10 times the absolute value of the time integral for the last-but-two pulse and a polarity opposite the last-but-two pulse, such that a control time window is produced for the at least one bistable cell, which control time window partially overlaps the last-but-one pulse to an extent of at least two fifths and nor more than four fifths of an entire duration of the control time window; and applying a data voltage waveform to the at least one bistable cell during at least the control time window.

2. A control method according to claim 1, wherein the control time window starts during the second half of the last-but-one pulse and terminates after the first fifth of the last pulse, the last pulse overlapping the control time window for at least one fifth of a duration of the control time window.

3. A control method according to claim 1, wherein the control time window is split into a plurality of subwindows at which sign inversions associated with the last-but-one pulse occur.

4. A control method according to claim 1, wherein the selection voltage waveform is applied to each of a plurality of selected bistable cells to perform a refresh operation, and a separate data voltage waveform is applied to each of the selected bistable cells.

5. A control method according to claim 4, wherein the selection voltage waveform includes a pause subsequent to the last-but-three pulse, the pause having a duration which ranges from a total duration of the consecutive last-but-three pulse and last-but-two pulse to a duration of one half of a minimum time between two consecutive refresh operations.

6. A control method according to claim 4, wherein separate time shifted selection voltage waveforms are applied to the plurality of bistable cells so that at least one group of bistable cells are defined in which each bistable cell of the at least one group corresponds to a different control time window, and a same data voltage waveform is applied to each of the bistable cells in the at least one group, such that a different data voltage segment of the same data voltage waveform, which data voltage segment conveys a data element, is applied to each of the bistable cells in the at least one group.

7. A control method according to claim 6, wherein each data voltage segment and each selection voltage waveform having identical average values independent of either a data item conveyed by the data voltage segment or the selected pixel, said average value being taken as a reference value for measuring each voltage.

8. A control method according to claim 6, wherein each selection voltage waveform further includes a last-but-four pulse opposite in polarity from the last-but-three pulse, such that an average voltage value of each selection voltage waveform is a predetermined value independent of a rate of application of the selection voltage waveforms to the plurality of bistable cells.

9. A control method according to claim 6, wherein an integral of a waveform in each data voltage segment with respect to time, computed from the beginning of the data voltage segment up to any time within the data voltage segment is a time function having an approximately null average value over the data voltage segment independent of any data item conveyed by the data voltage segment.

10. A control method according to claim 6, wherein the rms amplitude for each data voltage segment is a same predetermined value, even when data items conveyed by each data voltage segment are different.

11. A control method according to claim 10, wherein a rms amplitude of the data voltage waveform effects a high-frequency stabilization of the bistable cells.

12. A control method according to claim 10, wherein each data voltage segment corresponds to a waveform made up by two or three consecutive rectangular data pulses of opposite polarity, such that each data pulse has a data pulse voltage, a data pulse time, and a product of the data pulse voltage and the data pulse time, the product of the first data pulse is a function of a desired shade of the at least one bistable cell, and the sum of the products of all data pulses is zero.

13. A control method according to claim 10, wherein each data voltage segment corresponds to a waveform made up by three or four consecutive rectangular data pulses of opposite polarity, such that each data pulse has a data pulse voltage, a data pulse time and a produce of the data pulse voltage and the data pulse time, the product of the first data pulse is a function of a desired shade of the at least one bistable cell, the sum of the products of all data pulses is zero, and an integral of a waveform of each data voltage segment with respect to time from the beginning of the data voltage segment up to any time within the data voltage segment is a time function having an approximately null average value over the data voltage segment.

14. A control method according to claim 1, wherein peak amplitudes of the last-but-one pulse and of the last pulse are in the range from one tenth of the minimum switching time voltage Vtmin to twice the minimum switching time voltage vtmin, and peak amplitudes of all other pulses are lower than or equal to four thirds of the amplitude of the last pulse.

15. A control method according to claim 1, wherein the selection voltage waveform further includes pulses having a voltage integral with respect to time lower than 0.2 Amin.

16. A control method according to claim 1, wherein the selection voltage waveform further includes a high frequency voltage having a rms amplitude which is constant with respect to time.

17. A control method according to claim 1, wherein a rms amplitude of the data voltage waveform is constant, and effects a high-frequency stabilization of the at least one bistable cell.

18. A control method according to claim 1, wherein a rms amplitude of a portion of the data voltage waveform corresponding to the control window is in the range from one tenth to four thirds of a peak amplitude of the selection voltage waveform.

19. A liquid crystal display, comprising:

a plurality of picture elements, each picture element including an electro-optical bistable cell with a ferroelectric liquid crystal, the bistable cell switching between a first state and a second state in response to spaced apart rectangular pulses having alternately opposite polarities and a constant rms, voltage amplitude Vhf applied between the spaced apart rectangular pulses, when switching pulses having a large enough product of a switching pulse time and a switching pulse voltage, such large enough product having a minimum value Amin when the switching pulse voltage ranges from one to eight tenths of a minimum voltage Vtmin which allows a minimum switching pulse time;

selection voltage waveform application means, for applying a selection voltage waveform to at least one bistable cell, the selection voltage waveform including a last pulse having an absolute value of the time integral of the last pulse voltage in the range of 0.2 Amin to 1 Amin, a last-but-one pulse immediately preceding the last pulse, having an absolute value of the time integral of the last-but-one pulse voltage in the range of 0.2 Amin to 3 Amin, a last-but-two pulse having an absolute value of the time integral of the last-but-two pulse voltage in the range of 0.8 Amin to 3 Amin, and a last-but-three pulse having an absolute value of the time integral of the last-but-three pulse voltage in the range of 1 to 10 times the absolute value of the time integral for the last-but-two pulse and a polarity opposite the last-but-two pulse, such that a control time window is produced for the at least one bistable cell, which control time window partially overlaps the last-but-one pulse to an extent of at least two fifths and nor more than four fifths of an entire duration of the control time window; and data voltage waveform application means, for applying a data voltage waveform to the at least one bistable cell during at least the control time window.

20. A display according to claim 19, wherein the control time window starts during the second half of the last-but-one pulse and terminates after first fifth of the last pulse, the last pulse overlapping the control time window for at least one fifth of a duration of the control time window.

21. A display according to claim 19, wherein the control time window is split into a plurality of subwindows at which sign inversions associated with the last-but-one pulse occur.

22. A display according to claim 19, wherein the selection voltage waveform application means applies time shifted selection voltage waveforms to each of a plurality of selected bistable cells to perform a refresh operation, and the data voltage waveform application means applies a separate data voltage waveform is applied to each of the selected bistable cells.

23. A display according to claim 22, wherein the selection voltage waveform includes a pause subsequent to the last-but-three pulse, the pause having a duration which ranges from a total duration of the consecutive last-but-three pulse and last-but-two pulse to a duration of one half of a minimum time between two consecutive refresh operations.

24. A display according to claim 22, wherein separate time shifted selection voltage waveforms are applied to the plurality of bistable cells so that at least one group of bistable cells are defined in which each bistable cell of the at least one group corresponds to a different control time window, and a same data voltage waveform is applied to each of the bistable cells in the at least one group, such that a different data voltage segment of the same data voltage waveform, which data voltage segment conveys a data element, is applied to each of the bistable cells in the at least one group.

25. A display according to claim 24, wherein each selection voltage waveform further includes a last-but-four pulse opposite in polarity from the last-but-three pulse, such that an average voltage value of each selection voltage waveform is a predetermined value independent of a rate of application of the selection voltage waveforms to the plurality of bistable cells.

26. A display according to claim 24, wherein an integral of a waveform in each data voltage segment with respect to time, computed from the beginning of the data voltage segment up to any time within the data voltage segment is a time function having an approximately null average value over the data voltage segment independent of any data item conveyed by the data voltage segment.

27. A display according to claim 24, wherein the rms amplitude for each data voltage segment is a same predetermined value, even when data items conveyed by each data voltage segment are different.

28. A display according to claim 27, wherein a rms amplitude of the data voltage waveform effects a high-frequency stabilization of the bistable cells.

29. A display according to claim 27, wherein each data voltage segment corresponds to a waveform made up by two or three consecutive rectangular data pulses of opposite polarity, such that each data pulse has a data pulse voltage, a data pulse time, and a product of the data pulse voltage and the data pulse time, the product of the first data pulse is a function of a desired shade of the at least one bistable cell, and the sum of the products of all data pulses is zero.

30. A display according to claim 27, wherein each data voltage segment corresponds to a waveform made up by three or four consecutive rectangular data pulses of opposite polarity, such that each data pulse has a data pulse voltage, a data pulse time and a produce of the data pulse voltage and the data pulse time, the product of the first data pulse is a function of a desired shade of the at least one bistable cell, the sum of the products of all data pulses is zero, and an integral of a waveform of each data voltage segment with respect to time from the beginning of the data voltage segment up to any time within the data voltage segment is a time function having an approximately null average value over the data voltage segment.

31. A display according to claim 19, wherein peak amplitudes of the last-but-one pulse and of the last pulse are in the range from one tenth of the minimum switching time voltage Vtmin to twice the minimum switching time voltage Vtmin, and peak amplitudes of all other pulses are lower than or equal to four thirds of the amplitude of the last pulse.

32. A display according to claim 19, wherein the selection voltage waveform further includes pulses having a voltage integral with respect to time lower than 0.2 Amin.

33. A display according to claim 19, wherein the selection voltage waveform further includes a high frequency voltage having a rms amplitude which is constant with respect to time.

34. A display according to claim 19, wherein a rms amplitude of the data voltage waveform is constant, and effects a high-frequency stabilization of the at least one bistable cell.

35. A display according to claim 19, wherein a rms amplitude of a portion of the data voltage waveform corresponding to the control window is in the range from one tenth to four thirds of a peak amplitude of the selection voltage waveform.

36. A display according to claim 19, wherein the ferroelectric liquid crystal of the at least one cell is a smectic C chiral type ferroelectric liquid crystal, with a dielectric tensor corresponding to negative anysotropy and positive biaxiality.

37. A display according to claim 36, wherein an absolute value of the dielectric anysotropy is in the range from one half to ten times an absolute value of the biaxiality.

38. A display according to claim 36, wherein a ratio between a value of spontaneous polarization and an absolute value of the dielectric anysotropy is lower than 80 V/$\mu$m.

39. A display according to claim 19, wherein the ferroelectric liquid crystal of the at least one cell is a chevron oriented smectic C chiral type ferroelectric liquid crystal, such that smectic layers of the ferroelectric liquid crystal approximately divided into two halves, which halves are tilted with respect to a line normal to the at least one cell, in opposite directions, at an angle in a range from 110% and 75% of the characteristic angle of the SmC phase.

40. A display according to claim 39, wherein the ferroelectric liquid crystal of the at least one cell has a spontaneous polarization in a range from 2 nC/cm$^2$ to 15 nC/cm$^2$.

41. A display according to claim 19, wherein the selection voltage waveform application means includes a set of first electrodes, each first electrode being directly connected to a first side of a corresponding bistable cell; and the data voltage waveform application means includes a set of second electrodes, each second electrode being directly connected to a second side of a corresponding bistable cell.

42. A display according to claim 19, wherein, if all of the amplitudes or all of the durations in the waveforms are changed according to a single scale factor, the final value of an optical response of the at least one bistable cell is lower than three times the change in the waveforms.

* * * * *